US006772539B1

(12) United States Patent
Tai

(10) Patent No.: US 6,772,539 B1
(45) Date of Patent: Aug. 10, 2004

(54) SHOES

(75) Inventor: Chin-Hsing Tai, Taichung Hsien (TW)

(73) Assignee: Treasury Co., Ltd., Taichung (TW)

( * ) Notice: Subject to any disclaimer, the term of this patent is extended or adjusted under 35 U.S.C. 154(b) by 0 days.

(21) Appl. No.: 10/402,042

(22) Filed: Mar. 28, 2003

(51) Int. Cl.[7] ..... A43B 3/12

(52) U.S. Cl. ..... 36/11.5; 36/17 R; 36/22 R; 36/23

(58) Field of Search ..... 36/11.5, 17 R, 36/22 R, 23, 24, 101

(56) References Cited

U.S. PATENT DOCUMENTS 2,607,133 A * 8/1952 Marlowe ..... 36/11.5
3,063,167 A * 11/1962 Scholl ..... 36/11.5
3,890,725 A * 6/1975 Lea et al. ..... 36/11.5
4,172,330 A * 10/1979 Kao ..... 36/11.5
4,497,123 A * 2/1985 Ehrlich ..... 36/32 R
5,339,543 A * 8/1994 Lin ..... 36/101

* cited by examiner

*Primary Examiner*—Ted Kavanaugh
(74) *Attorney, Agent, or Firm*—William E. Pelton, Esq.

(57) ABSTRACT

Each shoe in accordance with the present invention has a shoe sole, an upper, reinforcing pieces, a welt and nails. The shoe sole has a top surface, a bottom surface, a round side, slots and reinforcing pieces. The slots are defined through the top surface near the round side of the shoe sole. The reinforcing pieces are mounted respectively in the slots. The upper has bottom edge. The welt is attached to the bottom edge of the upper. Nails are driven into the shoe sole through the welt and the reinforcing pieces in the slots to attach the upper to the shoe sole. The reinforcing pieces provide a resilient pliable medium to hold the nails so the shoes in accordance with prevent invention can be used for longer time.

6 Claims, 6 Drawing Sheets

SHOES

BACKGROUND OF THE INVENTION

1. Field of Invention

The present invention relates to shoes, and more particularly to shoes that have an enhanced structure and can be used for a long time.

2. Description of the Related Art

Shoes protect user's feet and provide comfortable feeling to users. Conventional shoe has a shoe sole and an upper. Conventional shoes use glue or nails to attach the upper to the shoe sole. Glue used to produce conventional shoes easily breaks down as the glue ages, so conventional shoes cannot be used for a long time. With reference to FIG. 6, a shoe sole (40) should be produced from a stronger material (for example: wood) when nails are used to attach an upper (41) to a shoe sole (40) so the nails will hold in the material. When the shoe sole is not strong enough, nails easily fall out after a period of time so that the shoes break. Using a stronger material for a shoe sole will increase the cost of shoes, and the weight of the shoes will also increase.

To overcome the shortcomings, shoes that can be used for a long time and are lighter are still needed. Shoes in accordance with the present invention obviate or mitigate the aforementioned problems.

SUMMARY OF THE INVENTION

The primary objective of shoes in accordance with the present invention is to provide shoes that can be used for a long time and are safe to the environment.

To achieve the objective, each shoe in accordance with the present invention comprises a shoe sole and an upper. The shoe sole has a top surface, a bottom surface, a round side, several slots and several reinforcing pieces. Several slots are defined on the top surface of the shoe sole. The upper has a welt around the edge of the upper and several nails. The upper with the welt is attached to the shoe sole by nails. Because the reinforcing pieces provide a strong bond, the shoes in accordance with prevent invention can be used for a longer time.

Other objectives, advantages and novel features of the invention will become more apparent from the following detailed description when taken in conjunction with the accompanying drawings.

DETAILED DESCRIPTION OF THE INVENTION

Figure 1:
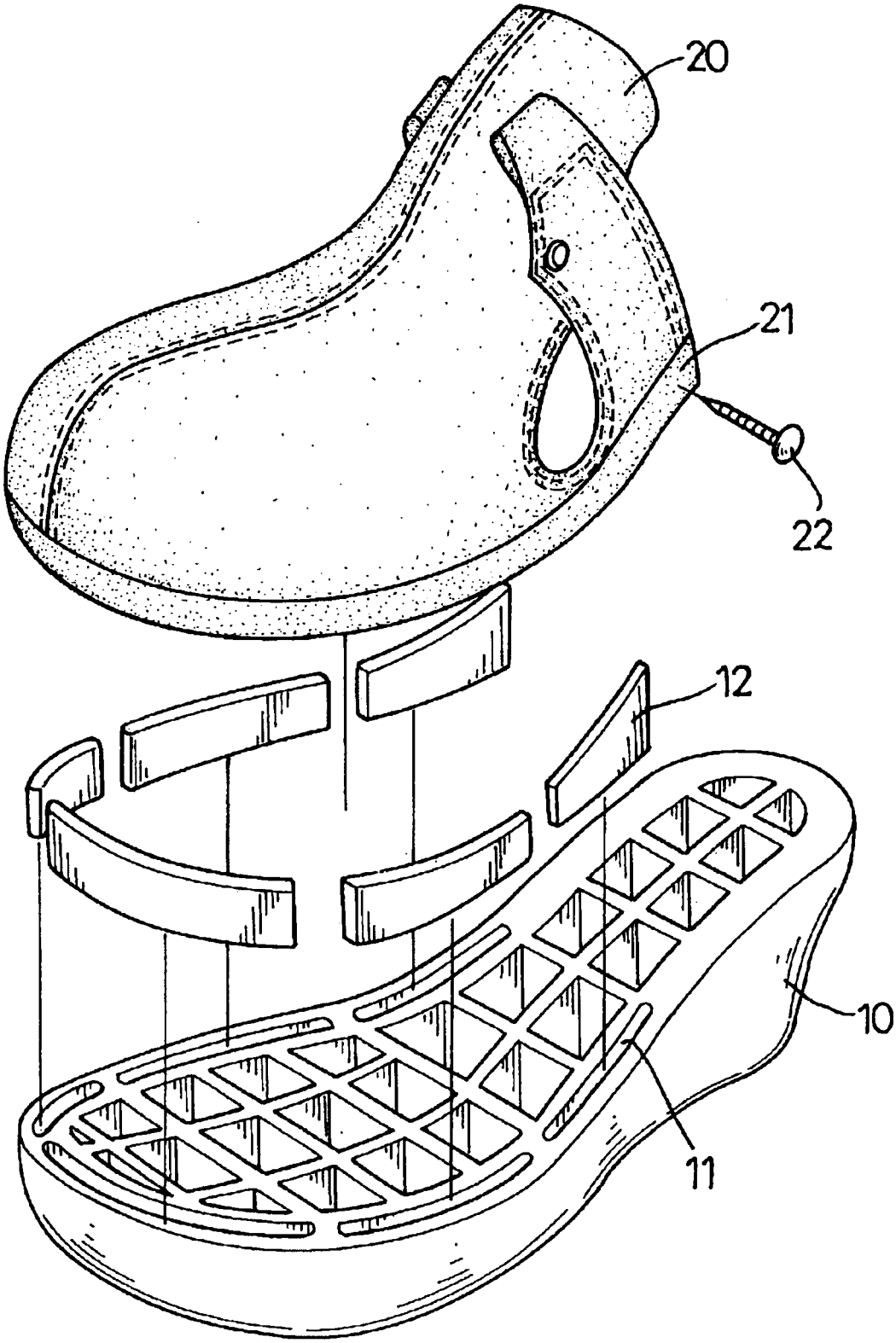
FIG. 1 is an exploded perspective view of a first embodiment of a shoe in accordance with the present invention.
Figure 2:
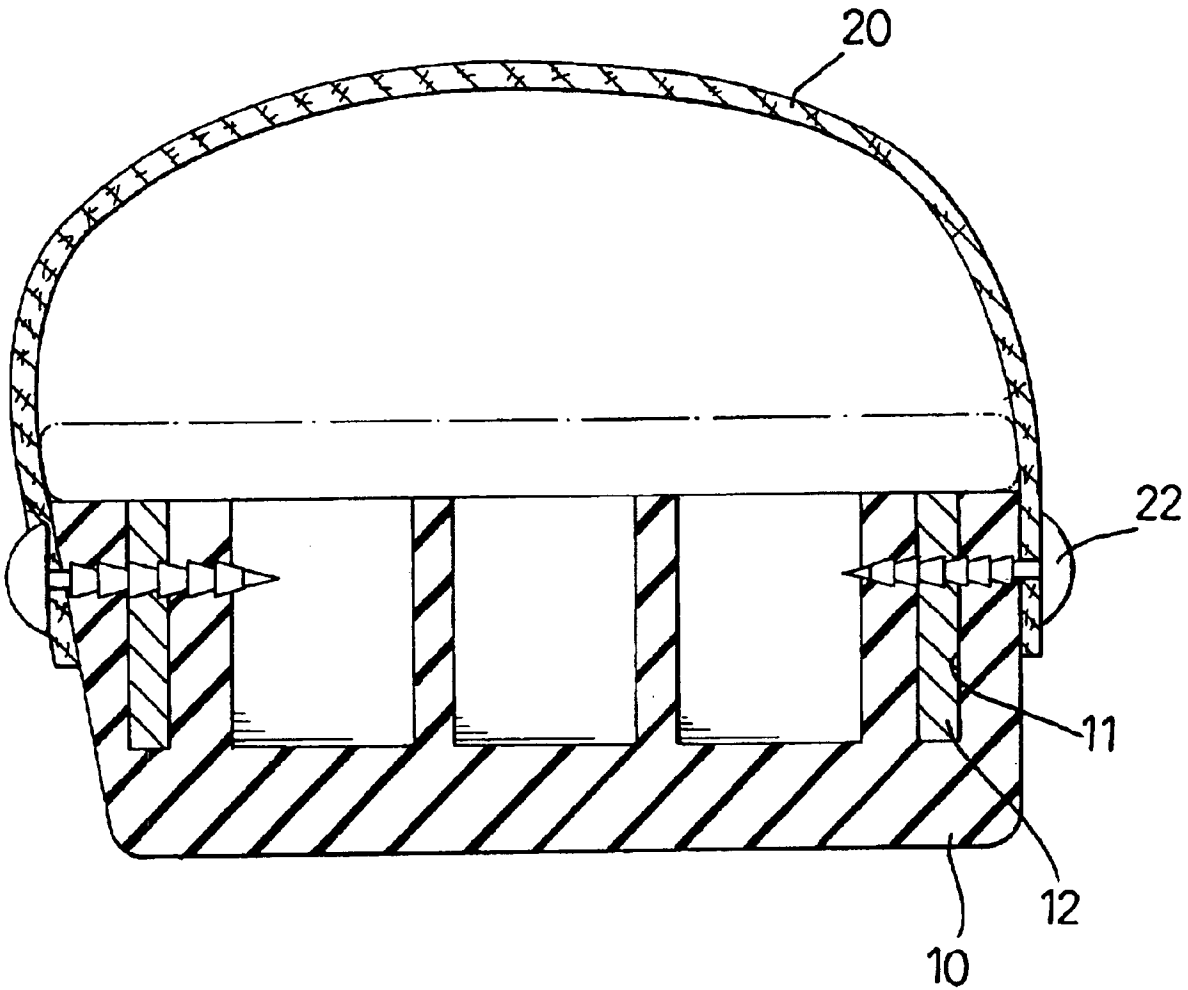
FIG. 2 is a cross sectional front plan view of the shoe in FIG. 1.

With reference to FIGS. 1 and 2, a shoe in accordance with the present invention comprises a shoe sole (10), an upper (20), reinforcing pieces (12) and multiple nails (22).

The shoe sole (10) is the base of a shoe, can be made of plastic and has a top surface (not numbered), a bottom surface (not numbered), a round side (not numbered), slots (11) and square recesses (not numbered). The slots (11) and square recesses are defined through the top surface. Each slot (11) is defined near the round side, and the slots (11) are formed a belt inside the round side of the sole (10). A reinforcing piece (12) is mounted inside each slot (11). Each reinforcing piece (12) has a shape corresponding to the respective slot (11). The reinforcing piece (12) is made from a solid material, such as ABS (Acrylonitrile-Butadiene-Styrene) resins.

Figure 3:
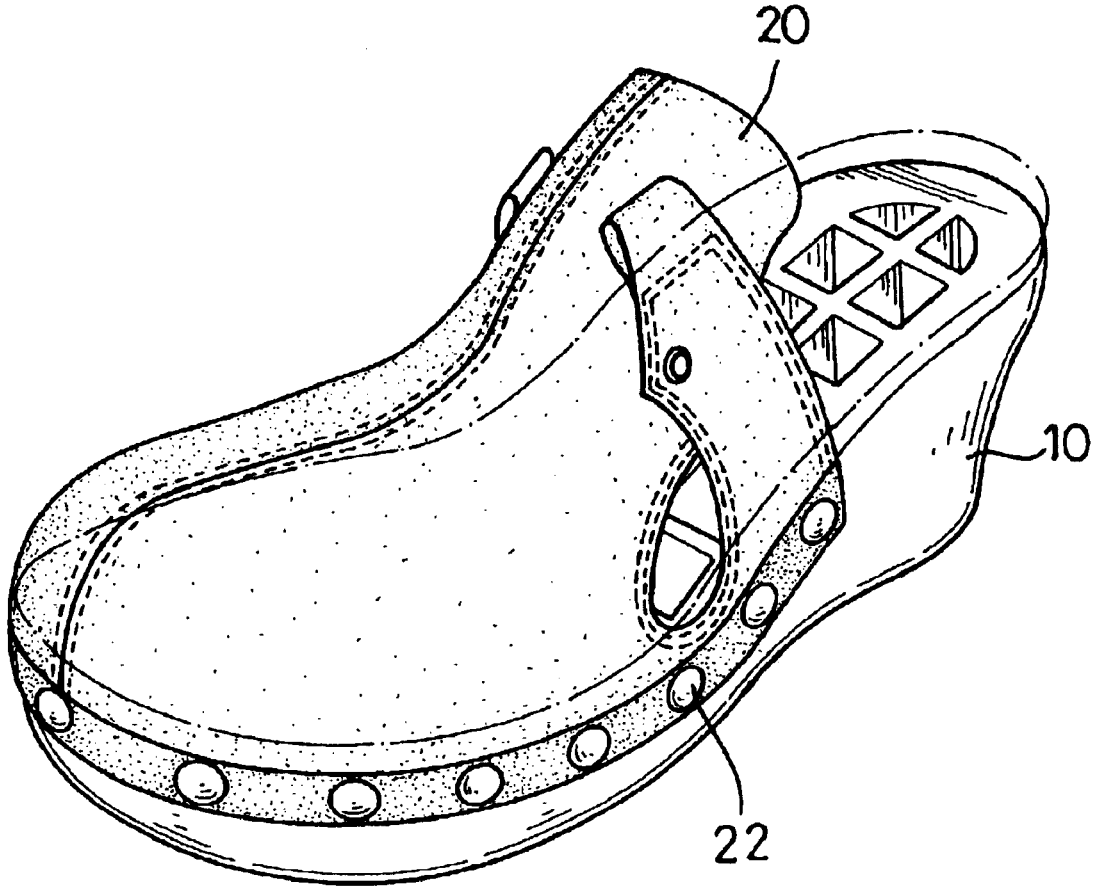
FIG. 3 is a perspective view of the shoe in FIG. 1.

The upper (20) has a lower edge (not numbered) and an outer surface (not numbered) and is attached to a welt (21) that is attached to the lower edge of the shoe sole (10) so the upper (20) can further protect a person's feet. The upper (20) can be made from leather or cloth. The welt (21) is bonded to the outer surface of the upper (20) around the lower edge. With further reference to FIGS. 1 and 3, multiple nails (22) with an enlarged head (not numbered) and a gripping shaft (not numbered) are nailed through the welt (21), the round side of the shoe sole (10), the slots (11) and the reinforcing pieces (12) to securely attach the upper (20) to the shoe sole (10). The shaft of each nail (22) has a sharp distal end (not numbered) and multiple annular hooks (not numbered). Each annular hook faces toward the head so much more force is required to remove the nail (22) than is required to drive the nail into the shoe sole (10).

Each reinforcing piece (12) provides a resilient and slightly pliable medium for the annular hooks on the nails to grip so the uppers (20) of the shoes in accordance with the present invention are securely attached to the shoe soles (10). The reinforcing pieces (12) can be wood or ABS resins. The annular hooks on the shafts of the nails (22) also serves to prevent the nails (22) from coming out of the shoe sole (10).

Figure 4:
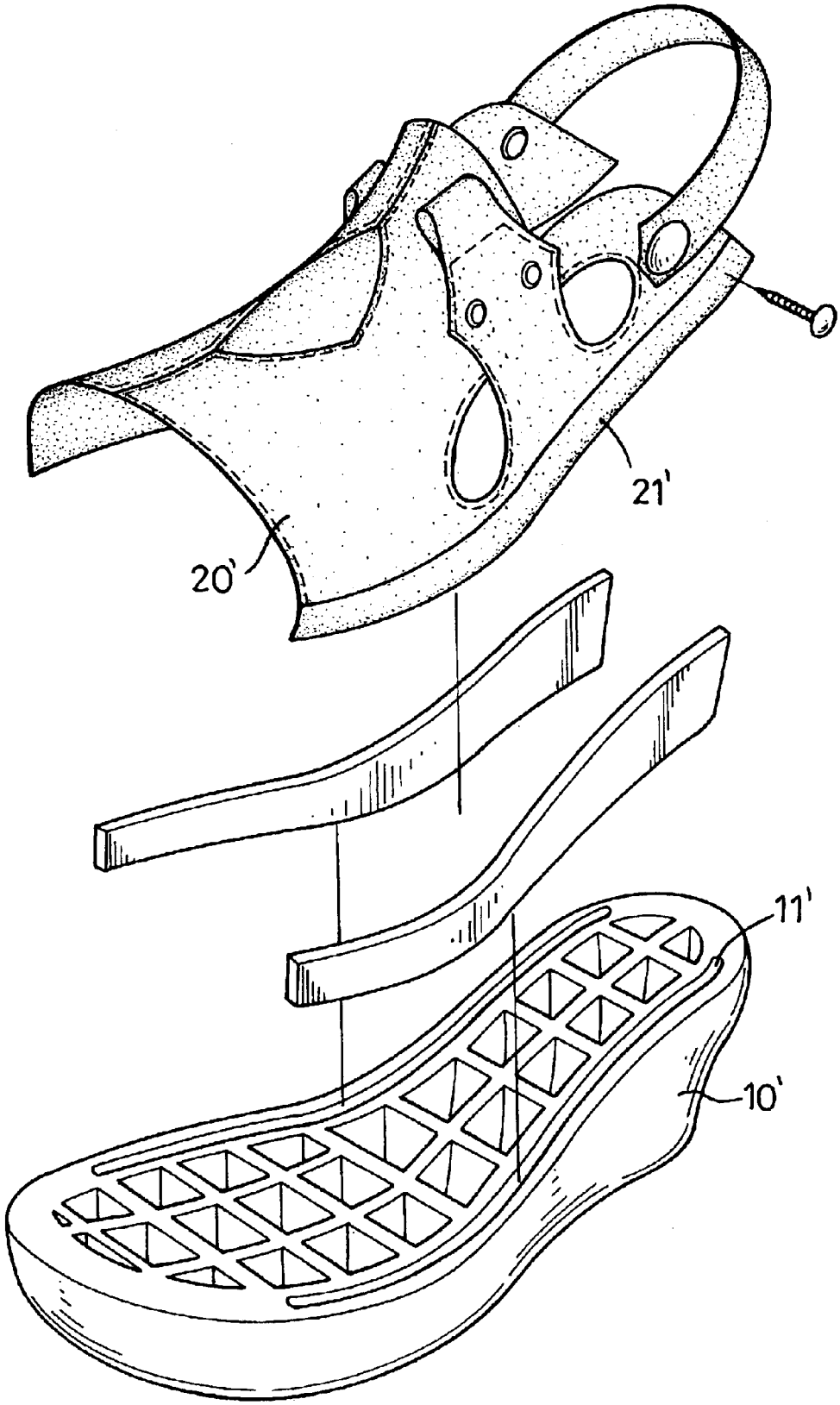
FIG. 4 is an exploded perspective view of a second embodiment of a shoe in accordance with the present invention.

With reference to FIG. 4, other embodiments of the shoes in accordance with the present invention can be formed in other styles. The upper (20') may be a sandal with a welt (21'), and the slots (11') in the soles (10') could be formed to match the welt (21').

Figure 5:
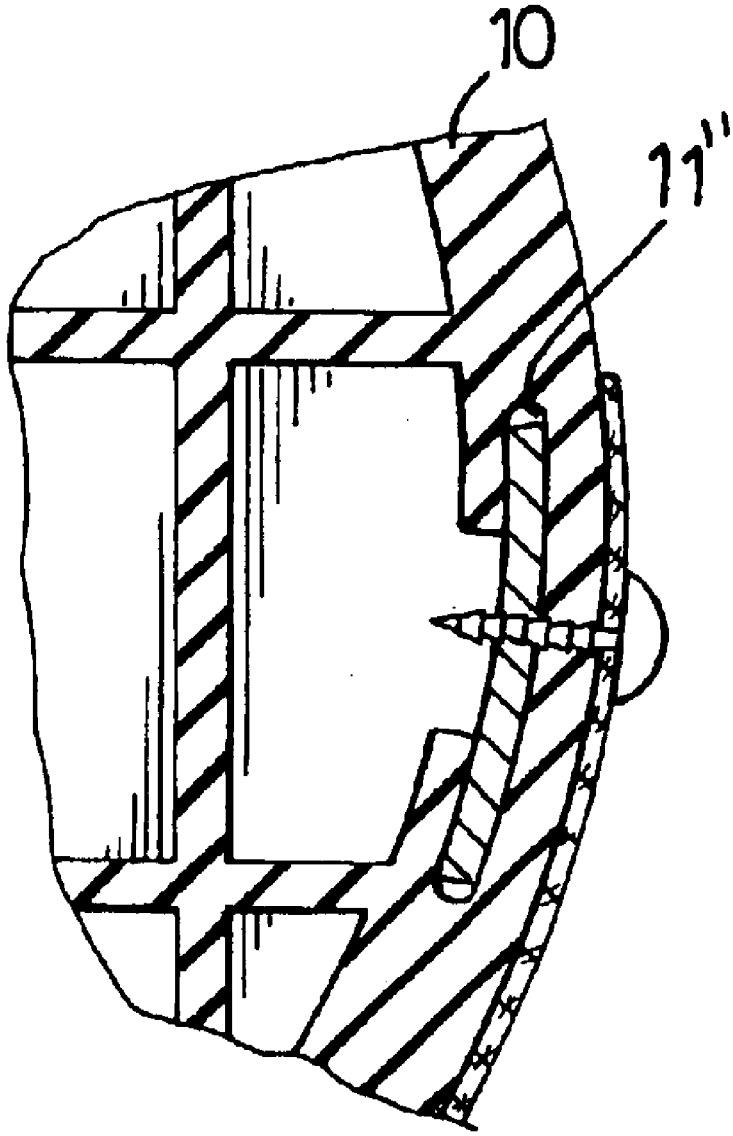
FIG. 5 is an enlarged top plan view in partial section of a third embodiment of a shoe in accordance with present invention.
Figure 6:
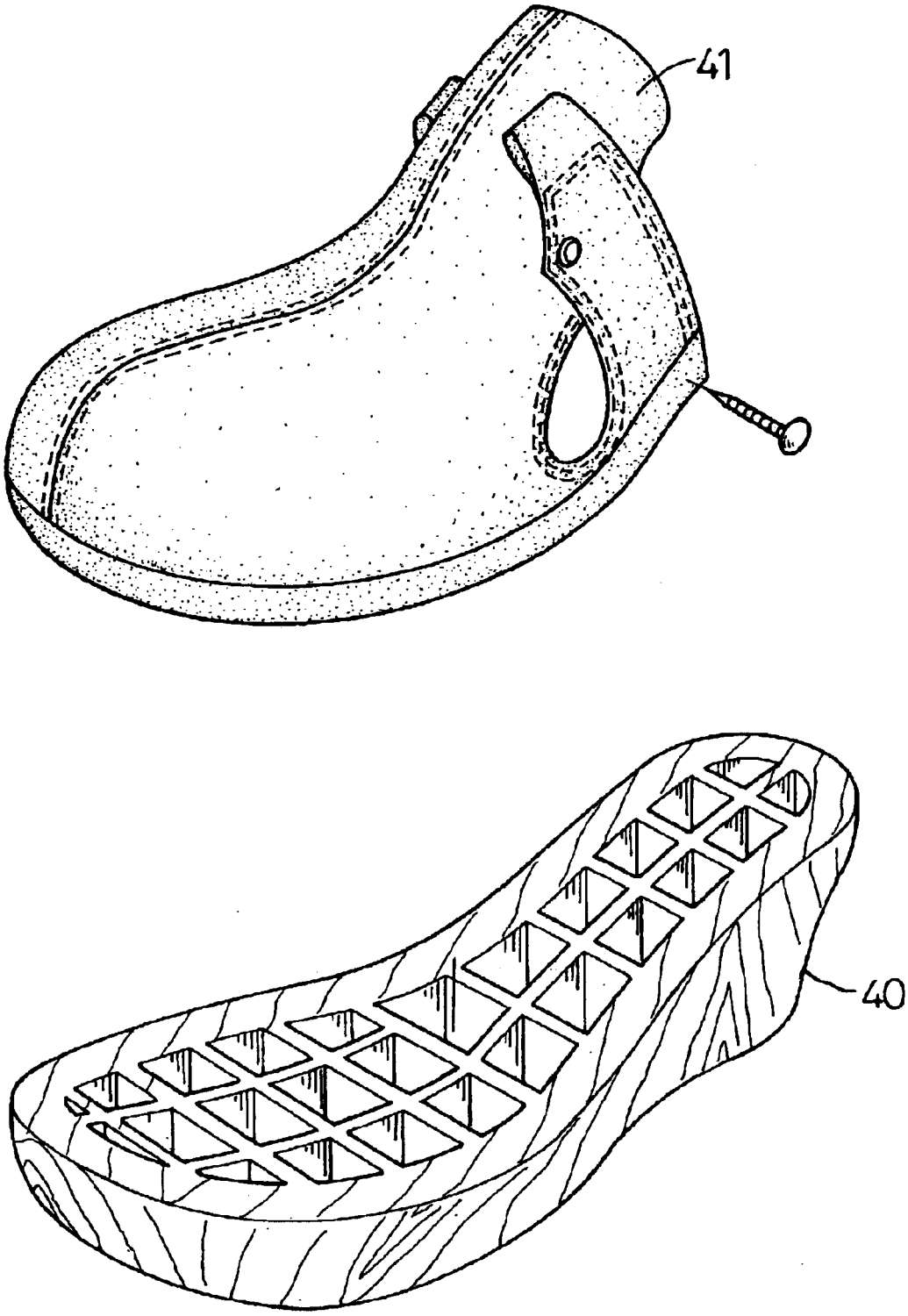
FIG. 6 PRIOR ART
FIG. 6 is an exploded perspective view of a conventional shoe in accordance with the prior art.

With reference to FIG. 5, another embodiment of a shoe in accordance with the present invention has slots (11") in the shoe sole (10) partially open to adjacent square recesses in the shoe sole (10) to further reduce the shoe sole's (10) weight.

The invention may be varied in many ways by a person skilled in the art. Such variations are not to be regarded as a departure from the spirit and scope of the invention, and all such modifications are intended to be included within the scope of the following claims.

What is claimed is:

1. A shoe comprising:

a shoe sole with a top surface, a round side, slots, and reinforcing pieces;

each slot being defined through the top surface near the round side; and a reinforcing piece being mounted inside each slot;

an upper with a bottom edge connected to the shoe sole through a welt securely attached to the bottom edge of the upper; and multiple fasteners driven into the shoe sole through the welt and the reinforcing pieces.

2. The shoes as claimed in claim 1, wherein multiple square recesses are formed through the top surface of the shoe sole.

3. The shoes as claimed in claim 1, wherein each reinforcing piece has a shape corresponding to that of the slot in which the reinforcing piece is mounted.

4. The shoes as claimed in claim 2, wherein each reinforcing piece has a shape corresponding to that of the slot in which the reinforcing piece is mounted.

5. The shoes as claimed in claim 4, wherein the slots are defined to be open to the adjacent square recess.

6. The shoes as claimed in claim 1, wherein the multiple fasteners are nails each having an enlarged head and a shaft with a sharp distal end.

* * * * *